US006734378B1

(12) United States Patent
Godesa et al.

(10) Patent No.: US 6,734,378 B1
(45) Date of Patent: May 11, 2004

(54) OPERATING SHAFT FOR A MULTIPLE ELECTRICAL POWER CIRCUIT BREAKER AND METHOD FOR ITS PRODUCTION

(75) Inventors: Ludvik Godesa, Berlin (DE); Peter Petznik, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/869,052

(22) PCT Filed: Nov. 24, 1999

(86) PCT No.: PCT/DE99/03770

§ 371 (c)(1),
(2), (4) Date: Aug. 17, 2001

(87) PCT Pub. No.: WO00/39825

PCT Pub. Date: Jul. 6, 2000

(30) Foreign Application Priority Data

Dec. 23, 1998 (DE) ..... 198 60 717

(51) Int. Cl.[7] ..... H01H 3/00
(52) U.S. Cl. ..... 200/17 R; 200/401
(58) Field of Search ..... 200/17 R, 400, 200/401, 272, 273, 274, 48 RB, 254

(56) References Cited

U.S. PATENT DOCUMENTS 3,054,874 A 9/1962 Dickenson et al.
3,236,967 A 2/1966 Bottonari et al.
3,511,944 A * 5/1970 McClain et al. ..... 200/17 R
4,942,273 A * 7/1990 Furuhashi et al. ..... 200/61.54
5,165,295 A * 11/1992 Dohnal et al. ..... 74/436

FOREIGN PATENT DOCUMENTS

DE C1-4414095 10/1995
DE C1-19727853 11/1998

* cited by examiner

*Primary Examiner*—Michael Friedhofer
*Assistant Examiner*—Lisa Klaus
(74) *Attorney, Agent, or Firm*—Harness, Dickey & Pierce, P.L.C.

(57) ABSTRACT

An operating shaft (1) for operation of switching contacts in a multipole electrical power breaker has a shaft tube (2), which is intended to provide a rotating bearing, and levers (4) which project from it and are composed of dye-cast metal. These levers (4) are mounted on the shaft tube (2), which is formed from a tubular semi-finished product composed of a metal which has a higher melting point than that of the levers (4). All the levers on an operating shaft (1) can be formed as an integral dye-cast body (3) or as individual dye-cast bodies. The described configuration allows operating shafts (1) for power breakers of different sizes to be manufactured integrally.

8 Claims, 2 Drawing Sheets

OPERATING SHAFT FOR A MULTIPLE ELECTRICAL POWER CIRCUIT BREAKER AND METHOD FOR ITS PRODUCTION

This application is the national phase application under 35 U.S.C. § 371 of PCT International Application No. PCT/DE99/03770 which has an International filing date of Nov. 24, 1999, which designated the United States of America.

FIELD OF THE INVENTION

The invention relates to an operating shaft for operation of switching contacts in a multipole electrical power circuit breaker having levers, which project from a central shaft tube (which is intended to provide a rotating bearing) and which are composed of die-cast metal, for connecting the operating shaft to the switching contacts and to an energy store which operates the switching contacts. The invention also relates to a method for producing such an operating shaft.

BACKGROUND

An operating shaft has been disclosed in DE 197 27 853 C1. In order to simplify the production of relatively long operating shafts, such as those which are required for four-pole power circuit breakers and those with a high rated current, the cited document provides for relatively short operating shaft units to be coupled to one another. In contrast, it would appear to be advantageous if it were possible to provide integral operating shafts with identical characteristics for all sizes in a range of power circuit breakers, and which are produced using the same method. The invention is based on the object of providing an operating shaft having these characteristics.

SUMMARY OF THE INVENTION

According to the invention, the above object is achieved in that the shaft tube is formed by a section of a tubular semi-finished product which is composed of a metal which has a higher melting point than that of the levers which project from the shaft tube, and in that the levers are mounted on the shaft tube.

The invention combines with one another the advantages of operating shafts which are produced from prefabricated individual parts by soldering or welding, and those which are produced as die-cast parts in accordance with the cited DE 197 27 853 C1. The fitting of the levers to a shaft tube comprising a tubular semi-finished product allows operating shafts to be produced cost-effectively of any required length and with any required number of levers. The advantageous characteristics of the new operating shaft are thus related to the production of die-cast parts of smaller size than is the case according to the cited DE 197 27 853 C1. Among other factors, this considerably reduces the quality assurance effort.

Relatively short operating shafts, such as those which are required for power circuit breakers having a normal number of poles and with a low to medium rated current can be constructed, according to one refinement of the invention, in such a manner that all the levers are formed by an integral die-cast body, with sections of the die-cast body which enclose the shaft tube in the form of a casing being arranged between the levers. However, to produce long operating shafts, it may be better to form each lever as a unit with concentric projections adjacent to it on both sides. This allows there to be exposed sections of the tubular semi-finished product between the levers.

Should it be found that the fitting of a die-cast material to the tubular semi-finished product does not at the same time achieve a strength which is sufficient for transmitting the required forces, then suitable roughening, profiling or the arrangement of depressions in the semi-finished product can be used to improve the force fit. A good connection can in consequence be achieved with particularly low effort in that the tubular semi-finished product for the shaft tube is composed of steel and is at least externally electrochemically galvanized in conjunction with die-shaft zinc being used as the material for the levers.

An expedient method for producing operating shafts with the characteristics described above comprises the following steps:

- provision of a shaft tube composed of a tubular semi-finished product,
- provision of a split casting mold for at least one of the levers and concentric projections which extend in the axial direction of the semi-finished product on both sides of the lever,
- positioning of the shaft tube in the casting mold with a sealed closure on the circumference of the shaft tube,
- introduction of a molten liquid die-casting material into the casting mold in order to form the lever and the adjacent projections, which are concentric with respect to the shaft tube,
- opening of the casting mold once the die-casting material has cooled down to a reasonable extent, and removal of the shaft tube with die-cast bodies, which are attached thereto and have at least one lever and adjacent sections in the form of casings.

BRIEF DESCRIPTION OF THE DRAWINGS

The invention will be explained in more detail in the following text with reference to the exemplary embodiments, which are illustrated in the figures, in which.

In an illustration corresponding to that in FIG. 1.

Figure 4:
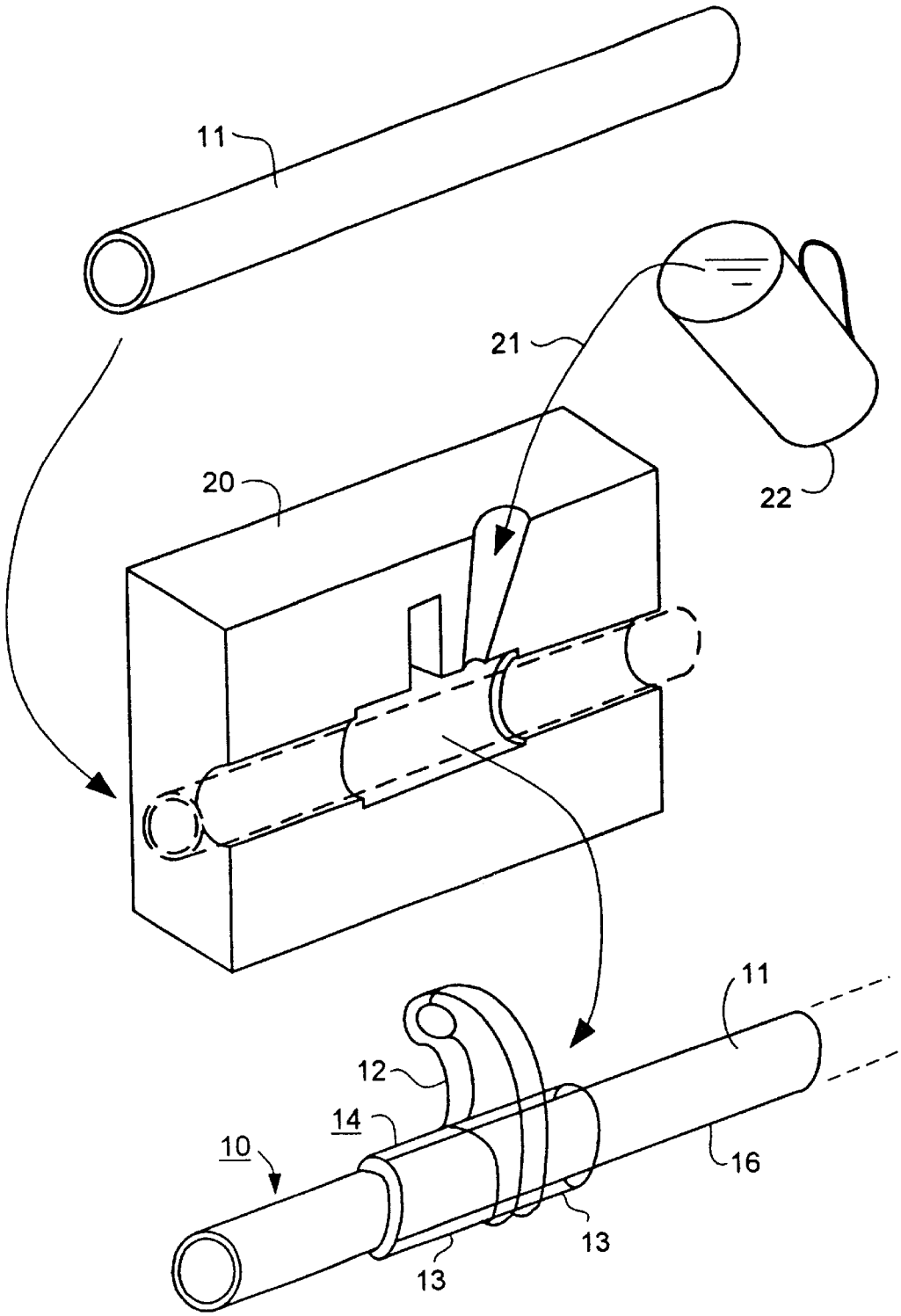

The method procedure for producing an operating shaft according to the invention is illustrated in FIG. 4.

DETAILED DESCRIPTION OF PREFERRED EMBODIMENTS

Figure 1:
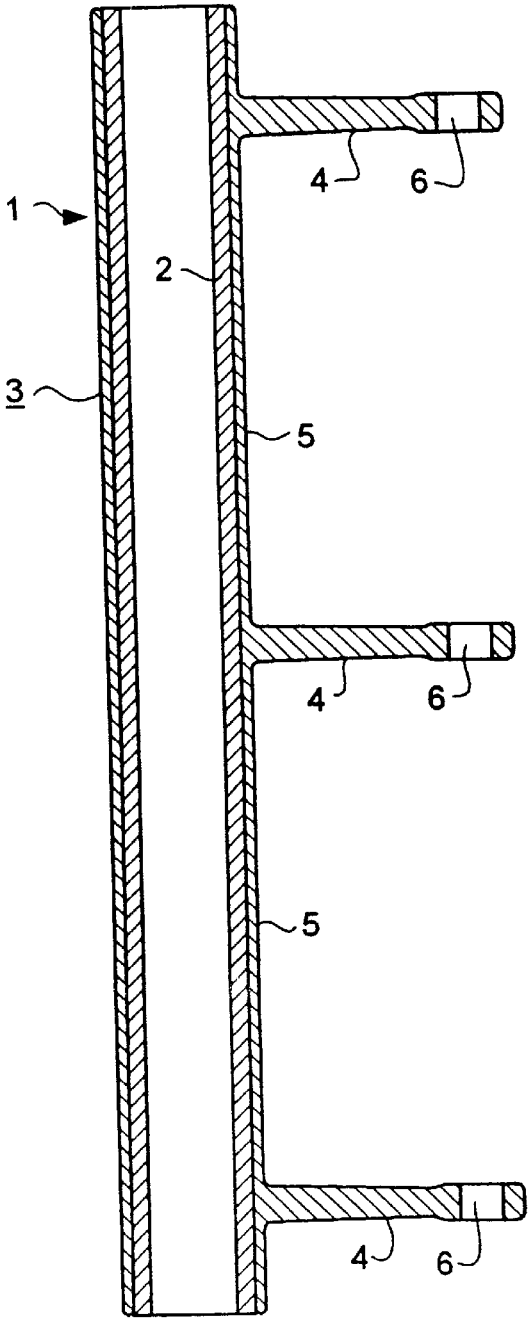
FIG. 1 shows a longitudinal section of an operating shaft for a low-voltage power circuit breaker.
Figure 2:
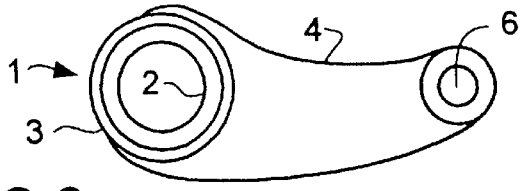
FIG. 2 shows an end view of the operating shaft shown in FIG. 1.

The operating shaft 1 as shown in FIGS. 1 and 2 has an inner shaft tube 2 which is formed by a section of a tubular semi-finished product composed of steel. This shaft tube 2 is surrounded over its entire length by an integral die-cast body 3. The lever 4 projects, approximately radially from the operating shaft 1, with a contour which can be seen in FIGS. 1 and 2. Sections 5 of the die-cast body 3, which surround the shaft tube 2 like a casing, are located between the total of three levers. In order to accommodate a hinge pin or a bearing bolt, the levers 4 have a through-opening 6 close to their outer end. These openings can be formed in the die-cast body 3 during production of the operating shaft 1.

Figure 3:
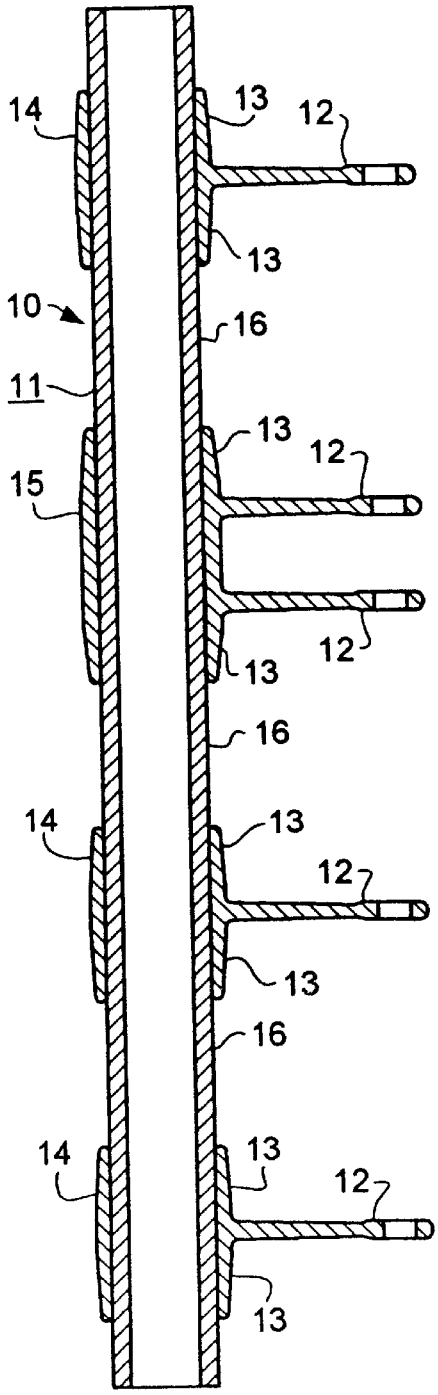
FIG. 3 shows a further exemplary embodiment of an operating shaft for a four-pole power circuit breaker.

The operating shaft 10, a further example of which is shown in FIG. 3, is intended for a four-pole power circuit breaker. The operating shaft 10 contains a tubular shaft tube 11, in the manner already described. However, in contrast to the exemplary embodiment shown in FIGS. 1 and 2, the shaft tube 11 is not surrounded by a die-cast body over its entire length. In fact, the levers 12 together with axially adjacent concentric projections 13 are formed by separate die-cast bodies 14 and 15. In this case, three die-cast bodies 14 each have one lever 12, and the individual die-cast bodies 15 have two such levers. Depending on the requirements for the magnitude of the forces to be transmitted, this or any other distribution and configuration of the die-cast bodies can obviously be provided. There are exposed sections 16 of the shaft tube 11 between the individual die-cast bodies 14.

The fundamental method procedure for producing the operating shafts 1 or 10 will be explained in the following text with reference to FIG. 4. In this case, in order to simplify the description, it is assumed that an operating shaft 10 as shown in FIG. 3 is intended to be produced, to be precise in such a manner that die-cast bodies 14 are fitted successively to a shaft tube 11.

The method as shown in FIG. 4 starts with the provision of a shaft tube 11 which is formed by a section of an externally galvanized steel tube, as has already been explained. The shaft tube 11 is introduced into a split casting mold 20, only half of which is shown. Depending on the desired procedure, the casting mold 20 is designed for individual levers for the operating shaft, or for all the levers provided for the switching shaft. Once the mold 20 has been closed, a zinc die-cast material is introduced (arrow 21, only one supply container 22 is indicated instead of a complex system as in a casting shop). After cooling down to a reasonable extent, the operating shaft 10, which has only partially been completed in this case, is removed from the casting mold 20. The other die-cast bodies 14 can be mounted on the shaft tube by introducing the operating shaft 10 successively into the casting mold 20. The galvanized surface of the shaft tube 2 or 11 results in a finer connection with the desired force fit. As mentioned initially, there are, however, other configurations which ensure the desired rotationally-fixed mounting of the levers on the shaft tube.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An operating shaft for operation of switching contacts in a multipole electrical power circuit breaker, having levers which project from a central shaft tube and which are composed of die-cast metal for connecting the operating shaft to the switching contacts and to an energy store which operates the switching contacts, comprising:

a shaft tube, formed by a section of a tubular semi-finished product including a metal which has a higher melting point than that of the levers which project from the shaft tube, wherein the levers are mounted on the shaft tube.

2. The operating shaft as claimed in claim 1, wherein, all the levers are formed by an integral dye-cast body, with sections of the die-cast body which enclose the shaft tube in the form of a casing being arranged between the levers.

3. The operating shaft as claimed in claim 2, wherein, the tubular semi-finished product for the shaft tube includes steel and is at least externally electrochemically galvanized in conjunction with die-cast zinc being used as the material for the levers.

4. The operating shaft as claimed in claim 1, wherein, the tubular semi-finished product for the shaft tube includes steel and is at least externally electrochemically galvanized in conjunction with die-cast zinc being used as the material for the levers.

5. The operating shaft as claimed in claim 1, wherein each lever is formed as a unit with concentric projections adjacent thereto on both sides, formed by a separate die-cast body.

6. A method for producing an operating shaft, comprising:

provisioning a shaft tube of a tubular semi-finished product;

provisioning a split casting mold for at least one lever and concentric projections to extend in an axial direction of the semi-finished product on both sides of the at least one lever;

positioning the shaft tube in the split casting mold with a sealed closure on the circumference of the shaft tube;

introducing a molten liquid dye-casting material into the split casting mold in order to form the at least one lever and the adjacent projections, which are concentric with respect to the shaft tube; and opening the casting mold once the die-casting material has cooled down to a reasonable extent, and removing the shaft tube with die-cast bodies, which are attached thereto and have at least one lever and adjacent sections in the form of casings.

7. A method of claim for producing an operating shaft, comprising:

provisioning a split casting mold for a lever, positioning a shaft tube in the split casting mold with a sealed closure on the circumference for the shaft tube, introducing a molten liquid die-casting material into the split casting mold in order to form at least one lever, which are concentric with respect to the shaft tube.

8. The method of claim 7, further comprising:

introducing a molten liquid die-casting material into the split casting mold in order to form at least one lever, which is concentric with respect to the shaft tube.

* * * * *